US008776490B2

(12) United States Patent
Tsao

(10) Patent No.: US 8,776,490 B2
(45) Date of Patent: Jul. 15, 2014

(54) NATURAL POLYMERIC YARN AND ITS FABRICATION METHOD AS WELL AS APPLICATION

(71) Applicant: Coreleader Biotech Co., Ltd., New Taipei (TW)

(72) Inventor: Teeming Tsao, New Taipei (TW)

(73) Assignee: Coreleader Biotech Co., Ltd., New Taipei (TW)

( * ) Notice: Subject to any disclaimer, the term of this patent is extended or adjusted under 35 U.S.C. 154(b) by 70 days.

(21) Appl. No.: 13/673,530

(22) Filed: Nov. 9, 2012

(65) Prior Publication Data

US 2014/0130934 A1 May 15, 2014

(51) Int. Cl.
*D02G 1/02* (2006.01)

(52) U.S. Cl.
USPC ..... 57/284; 57/247

(58) Field of Classification Search
USPC ..... 57/247, 284
See application file for complete search history.

(56) References Cited

U.S. PATENT DOCUMENTS

| | | | | |
|---|---|---|---|---|
| 3,943,220 | A * | 3/1976 | Barnett et al. | 264/103 |
| 6,330,786 | B1 * | 12/2001 | Settle | 57/200 |
| 7,337,555 | B2 * | 3/2008 | Uku et al. | 34/445 |
| 2009/0287308 | A1 * | 11/2009 | Davis et al. | 623/13.12 |
| 2010/0087856 | A1 * | 4/2010 | Park et al. | 606/228 |
| 2010/0162677 | A1 * | 7/2010 | Qiu et al. | 57/12 |
| 2010/0330351 | A1 * | 12/2010 | Crnoja-Cosic et al. | 428/219 |
| 2011/0120484 | A1 * | 5/2011 | Matsumoto et al. | 132/53 |

* cited by examiner

*Primary Examiner* — Shaun R Hurley
(74) *Attorney, Agent, or Firm* — Ming Chow; Sinorica, LLC

(57) ABSTRACT

A method for fabricating natural polymer yarn comprises the following steps: (a) forming a natural polymeric long fiber by wet spinning or electro spinning from a natural polymer solution; (b) combining the natural polymeric long fiber and at least one polymeric fiber by a false twist texturing process to form a natural polymeric yarn. A natural polymer yarn relates to the method. A natural polymer fabric includes said natural polymer yarn. A method of using said natural polymer fabric for medical dressing. By means of a false twist texturing process, the natural polymer yarn with enhanced tensile strength and elongation could reduce the drawback of conventional wound dressing products which lack strength and stretchiness in a wet condition.

11 Claims, 1 Drawing Sheet

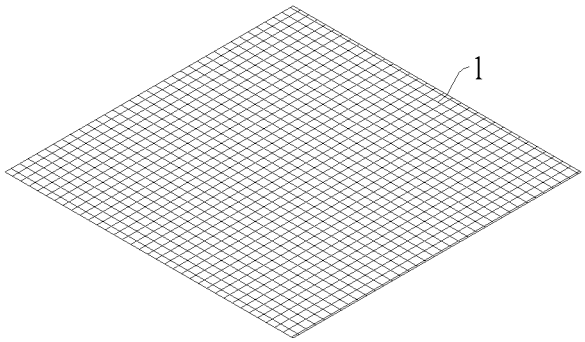
1

NATURAL POLYMERIC YARN AND ITS FABRICATION METHOD AS WELL AS APPLICATION

BACKGROUND OF THE INVENTION

1. Field of the Invention

The present invention relates to a method for fabricating a natural polymeric yarn. The present invention also relates to a natural polymeric yarn. The present invention also relates to a method for fabricating a natural polymeric fabric, and use of a natural yarn to weave and form the natural polymeric fabric. The present invention further relates to a natural polymeric fabric, and more particularly to the natural polymeric fabric formed by said natural polymeric yarn. The present invention yet further relates to a method of using said natural polymeric fabric for medical dressings.

2. Description of the Prior Arts

The conventional wound dressings are mostly comprised of cotton cushion or gauze and despite being used for decades, even centuries, it is found they cause higher infection because of bad antibacterial activity. Moreover, the conventional dressings stick to wounds easily and are difficult to replace with new dressings resulting in secondary injury. It is clear that such conventional wound dressings ironically aggravate wounds rather than help the healing process. Thus, the natural polymers such as alginate dressings or polysaccharide dressings are used for non-woven fabrics to replace cotton cushion or gauze. Though the non-woven fabrics have better absorption and provide a moist environment suitable for wound healing, the tensile strength thereof is low and elongation of non-woven fabrics is weak such that it is common for short fibers to remain in a wound while a dressing is being changed. The residual short fibers not only increase the risk of allergic response but also aggravate the difficulty of debridement, thereby causing the patient further and unnecessary pain.

SUMMARY OF THE INVENTION

To overcome the shortcomings of the short fibers lacking strength and stretchiness, the objective of the present invention is to provide a method for fabricating natural polymeric yarns with enhanced tensile strength and elongation rate by forming appropriate fibers and yarns and modifying twist levels of the natural polymeric yarn.

To achieve the above objective, the method in accordance with the present invention comprises the following steps:

(a) forming a natural polymeric long fiber by wet spinning or electro spinning from a natural polymeric solution; and (b) combining the natural polymeric long fiber and at least one polymeric fiber by false twist texturing process to form a natural polymeric yarn.

Preferably, the natural polymeric solution includes, but is not limited to a chitosan solution, a hyaluronic acid solution, a collagen solution and an alginate solution.

Preferably, the concentration of the natural polymeric solution is between 3% and 8% by weight of the total weight. More preferably, the concentration of the natural polymeric solution is between 4% and 6% by weight of the total weight.

According to the present invention, the term "wet spinning", as used herein, refers to the spinneret is submerged in a chemical bath that enables the natural polymeric solution to be spun and the long fiber to precipitate, and then long fiber is solidified while it is emerging in an appropriate solution.

According to the present invention, the term "electro spinning" as used herein refers to using an electrical charge to draw very fine fibers from the natural polymeric solution.

According to the present invention, the term "natural polymeric long fiber" as used herein refers to the natural polymeric long fiber is formed by immersing in a glycerol solution and using a drying step from the natural polymeric solution in wet spinning or electro spinning process, wherein the concentration of glycerol solution is 0.1% to 5.0% by weight of the total weight; wherein solvent of the glycerol solution is an ethanol aqueous solution, and the concentration of the ethanol aqueous solution is 20% to 80% by weight of the total weight.

Preferably, the at least one polymeric fiber includes, but is not limited to a natural polymeric fiber or a chemical polymeric fiber.

More preferably, the natural polymeric fiber includes, but is not limited to a chitosan fiber, a hyaluronic acid fiber, a collagen fiber and an alginate fiber.

More preferably, the chemical polymeric fiber includes, but is not limited to a polyester fiber, a nylon fiber, a polyethylene fiber and a polypropylene fiber.

According to the present invention, the term "false-twist texturing", as used herein, refers to a process in which a fiber is twisted, set and untwisted, and then the fiber becomes twisted and fluffy.

In a second aspect, the present invention provides a natural polymeric yarn made from the above-mentioned method.

Preferably, the twist level of said natural polymeric yarn is between 100 turns/meter (t/m) and 200 t/m, the tensile strength of said natural polymeric yarn is between 1.15 g/den and 1.25 g/den, and the elongation rate of said natural polymeric yarn is between 6.6% and 8.5%.

In a third aspect, the present invention provides a method for fabricating natural polymeric fabric comprises the following steps:

providing said natural polymeric yarns, and forming a natural polymeric fabric by weaving said natural polymeric yarns.

Preferably, the weaving includes, but is not limited to plain weaving, twill weaving, stain weaving and three-dimensional weaving.

In a fourth aspect, the present invention provides a natural polymeric fabric made from above mentioned method, wherein the natural polymeric fabric is comprised of natural polymeric yarns and at least one polymeric yarn.

Preferably, at least one polymeric yarn includes, but is not limited to a natural polymeric yarn or a chemical polymeric yarn.

More preferably, the natural polymeric yarn includes, but is not limited to a chitosan yarn, a hyaluronic acid yarn, a collagen yarn and an alginate yarn.

More preferably, the chemical polymeric yarn includes, but is not limited to a polyester yarn, a nylon yarn, a polyethylene yarn and a polypropylene yarn.

In a fifth aspect, the present invention provides a method of using the natural polymeric fabric for medical dressing comprises the following steps:

applying the medical dressing to cover or fill a wound.

Preferably, in the step of putting the medical dressing to cover or stuff wound, the wound includes, but is not limited to trauma wounds, decubitus wounds, scald wounds, diabetic foot ulcers, vein ulcers, large areas of damaged skin, chronic ulcers, and wounds requiring filling.

The method for fabricating natural polymeric yarn in accordance with the present invention utilizes naturally the polymeric long fiber to combine with at least one polymeric fiber in false-twist texturing process to form a natural polymeric yarn. The natural polymeric yarn with enhanced tensile strength and elongation rate by the twist level is between 100 t/m and 200 t/m, the tensile strength of said natural polymeric yarn is between 1.15 g/den and 1.25 g/den, and the elongation rate of said natural polymeric yarn is between 6.6% and 8.5%.

The natural polymeric fabric in accordance with the present invention is comprised of the polymeric yarns in accordance with the present invention. The natural polymeric fabric not only has better absorption and provides a wet environment for repairing wounds, but also enhances the tensile strength and the elongation rate of the natural polymeric fabric using for medical dressings. The advantage of the medical dressings with the fabric in accordance with the present invention is that such dressings could be removed easily from a wound without leaving residual matter therein. The natural polymeric fabric could be applied as a medical dressing on various conditions such as chronic, deeper and high-exudate wounds.

BRIEF DESCRIPTION OF THE DRAWING

FIG. 1 is a perspective view of a natural polymeric fabric in accordance with the present invention.

DETAILED DESCRIPTION OF THE PREFERRED EMBODIMENTS

Example 1

Preparation of Alginate Yarn

Alginate solutions of 4 wt % and 5 wt % were prepared by adding sterile water to alginate yarn powder. The alginate calcium fibers were formed by wet spinning, which includes extruding the alginate solution through a 250-orifice spinneret with each orifice having a diameter of 0.08 mm, and being solidified in a 5% calcium chloride solution. The alginate calcium fiber was subjected to washing by water, followed by dipping 1 vol % and 3 vol % glycerol onto the surface of fibers, and then drying to form alginate calcium long fibers. The alginate calcium long fiber was manufactured by twisting the alginate calcium fibers into an alginate yarn in various twist levels. The obtained alginate yarn with various twist levels were tested by ASTM D2256.

TABLE 1

The properties of alginate yarns

| Alginate yarn sample (t/m) | Denier (g) | Tensile (g/den) | Elongation (%) | Absorption (%) |
|---|---|---|---|---|
| 98 | 529.9 | 1.16 | 6.6 | 561 |
| 158 | 637.5 | 1.22 | 7.7 | 490 |
| 207 | 695.3 | 1.15 | 8.3 | 495 |
| 430 | 698.4 | 0.78 | 6.4 | 399 |
| 600 | 514.2 | 0.84 | 4.0 | 249 |

As shown in table 1, the tensile strength, elongation rate and absorption rate were better while the twist level is between 98 t/m and 207 t/m.

Example 2

Preparation of Chitosan Yarn

Chitosan solutions of 3 wt % and 8 wt % were prepared by dissolving chitosan in 2 vol % acetic acid aqueous solution. After being filtered, the chitosan fibers were formed in 5 wt % sodium hydroxide solution through a wet spinning machine. The chitosan fibers were subjected to washing by water, followed by dipping 0.1 vol % and 5 vol % glycerol onto the surface of fibers, and then drying to form chitosan long fibers. The chitosan long fibers were manufactured by twisting the chitosan long fibers into a chitosan yarn in various twist level.

Example 3

Preparation of Natural Polymeric Fabric

As shown in FIG. 1, the natural polymeric fabric 1 is produced by means of the alginate yarn from Example 1 and the chitosan yarn from Example 2 through the fabric sample loom machine by plain weaving.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A method for fabricating natural polymeric yarns, comprising steps of:

(a) forming a natural polymeric long fiber by wet spinning or electro spinning from a natural polymeric solution; and (b) combining the natural polymeric long fiber and at least one polymeric fiber by a false twist texturing process to form a natural polymeric yarn, wherein the twist level of the natural polymeric yarn is between 100 turns/meter (t/m) and 200 t/m, the tensile strength of the natural polymeric yarn is between 1.15 g/den and 1.25 g/den, and the elongation rate of the natural polymeric yarn is between 6.6% and 8.5%.

2. The method according to claim 1, wherein the natural polymeric solution is a chitosan solution, a hyaluronic acid solution, a collagen solution or an alginate solution.

3. The method according to claim 1, wherein the concentration of the natural polymeric solution is between 3% and 8% by weight of the total weight.

4. The method according to claim 1, wherein the concentration of the natural polymeric solution is between 4% and 6% by weight of the total weight.

5. The method according to claim 1, wherein the at least one polymeric fiber is a natural polymeric fiber or a chemical polymeric fiber.

6. The method according to claim 5, wherein the natural polymeric fiber is a chitosan fiber, a hyaluronic acid fiber, a collagen fiber or an alginate fiber; wherein the chemical polymeric fiber is a polyester fiber, a nylon fiber, a polyethylene fiber or a polypropylene fiber.

7. A method for fabricating natural polymeric fabric, comprising the following steps:

providing the natural polymeric yarns as in claim 1; and forming a natural polymeric fabric by weaving the natural polymeric yarns.

8. The method according to claim 7, wherein the weaving is plain weaving, twill weaving, stain weaving or three-dimensional weaving.

9. A natural polymeric fabric prepared by providing the natural polymeric yarns as in claim 1; and forming a natural polymeric fabric by weaving the natural polymeric yarns, wherein the natural polymeric fabric is comprised of the natural polymeric yarns and at least one polymeric yarn.

10. The natural polymeric fabric according to claim 9, wherein at least one polymeric yarn is a natural polymeric yarn or a chemical polymeric yarn.

11. The natural polymeric fabric according to claim 10, wherein the natural polymeric yarn is a chitosan yarn, a hyaluronic acid yarn, a collagen yarn or an alginate yarn; wherein the chemical polymeric yarn is a polyester yarn, a nylon yarn, a polyethylene yarn or a polypropylene yarn.

* * * * *